US005967060A

United States Patent [19]

Savoie

[11] Patent Number: 5,967,060

[45] Date of Patent: Oct. 19, 1999

[54] REMOVABLE AND FOLDABLE COUNTERTOP ASSEMBLY

[75] Inventor: Troy S. Savoie, Burnsville, Minn.

[73] Assignee: Media/Graphics, Inc., Minneapolis, Minn.

[21] Appl. No.: 09/126,861

[22] Filed: Jul. 31, 1998

[51] Int. Cl.[6] ..... A47B 3/06

[52] U.S. Cl. ..... 108/157.1; 108/115

[58] Field of Search ..... 108/115, 157.1, 108/158.12, 158.13, 159.11, 157.12, 150, 153.1, 27

[56] References Cited

U.S. PATENT DOCUMENTS

| | | | |
|---|---|---|---|
| 2,175,572 | 10/1939 | Ruhl | 108/157.1 X |
| 2,361,875 | 10/1944 | Sachs | 108/150 X |
| 2,539,781 | 1/1951 | Heaney | 108/27 |
| 2,556,943 | 6/1951 | Reisman | 108/157.1 X |
| 3,181,176 | 5/1965 | Nagy et al. | 108/27 X |
| 4,428,305 | 1/1984 | Creske | 108/150 |
| 5,461,989 | 10/1995 | Grandclement et al. | 108/153.1 |

*Primary Examiner*—Jose V. Chen

*Attorney, Agent, or Firm*—Westman, Champlin & Kelly, P.A.

[57] ABSTRACT

A folding top used on various pedestals is made in two sections that abut along a parting line and are urged toward the parting line by an elastic cord that provides a resilient force at two spaced locations along the parting line. The cord is a peripheral type cord that fits into a receptacle encircling the countertop on an underside thereof and within the periphery. The countertop has a flange that fits over the top of the pedestal for mounting in place and using it as a countertop. The countertop is foldable when the two sections are separated along a parting line for storage and transportation, and the pedestal is for storage cases used for storing and transporting display panels and display panel frames.

7 Claims, 5 Drawing Sheets

REMOVABLE AND FOLDABLE COUNTERTOP ASSEMBLY

BACKGROUND OF THE INVENTION

The present invention relates to a two-piece countertop assembly that is designed specifically for use in trade show booths and which will mount on top of a case in which components of trade show booths are transported, to provide a working counter surface at such trade show booth.

Movable partitions used for erecting various trade show booths that have collapsible frames covered by panels forming a skin, and which fit into a storage and transport case are well known in the art. The storage cases are designed to be very compact, and store the collapsible frames as well as panels that will roll or fold and which attach to the frames. The case or cases are generally put aside when the booth is erected, and are not used then until the booth is again disassembled. Use of table space is desired in these booths for various functions, and the present invention provides for a collapsible, automatically erecting, and usable top that will form a counter that rests on the storage cases to utilize the cases as a pedestal for the counter. The countertop is easily removed and replaced onto the storage cases, and can be folded easily as well.

SUMMARY OF THE INVENTION

The present invention relates to a countertop specifically used for use in connection with trade show display booths that are collapsible and which mount on storage cases which are used for storing the panels and covering skins for the panels during transport from one show to another. The countertop is made to slip over the upper ends of one or more of the cases, and form a counter that is usable in the booth. The cases themselves can have flexible skin covering on them to improve the appearance of the cases. The countertop is very utilitarian in that it provides a work space using cases that normally would just be in the way.

The countertop is made in two sections that are held together with an encircling elastic cord placed into a peripheral groove formed by a molded channelaround the two countertop sections when erected. When folded, the cord bends at the fold so that the two portions of the countertop can be made placed contiguously. The adjoining edges of the two countertop sections have interfitting tabs that provide support at the adjoining edges when the sections are held together under the elastic load from the encircling cord. The countertop remains in place, and is sufficiently rigid for use as a writing top or support top.

The countertops can be made so that they will fit onto one storage case or two cases placed side by side.

The tops are easily molded, and thus easily used. Tops can of course can be used with other supports as well and form a stored countertop that can be assembled quickly to provide a flat countertop surface mounted onto a pedestal.

DETAILED DESCRIPTION OF THE PREFERRED EMBODIMENTS

Figure 1:
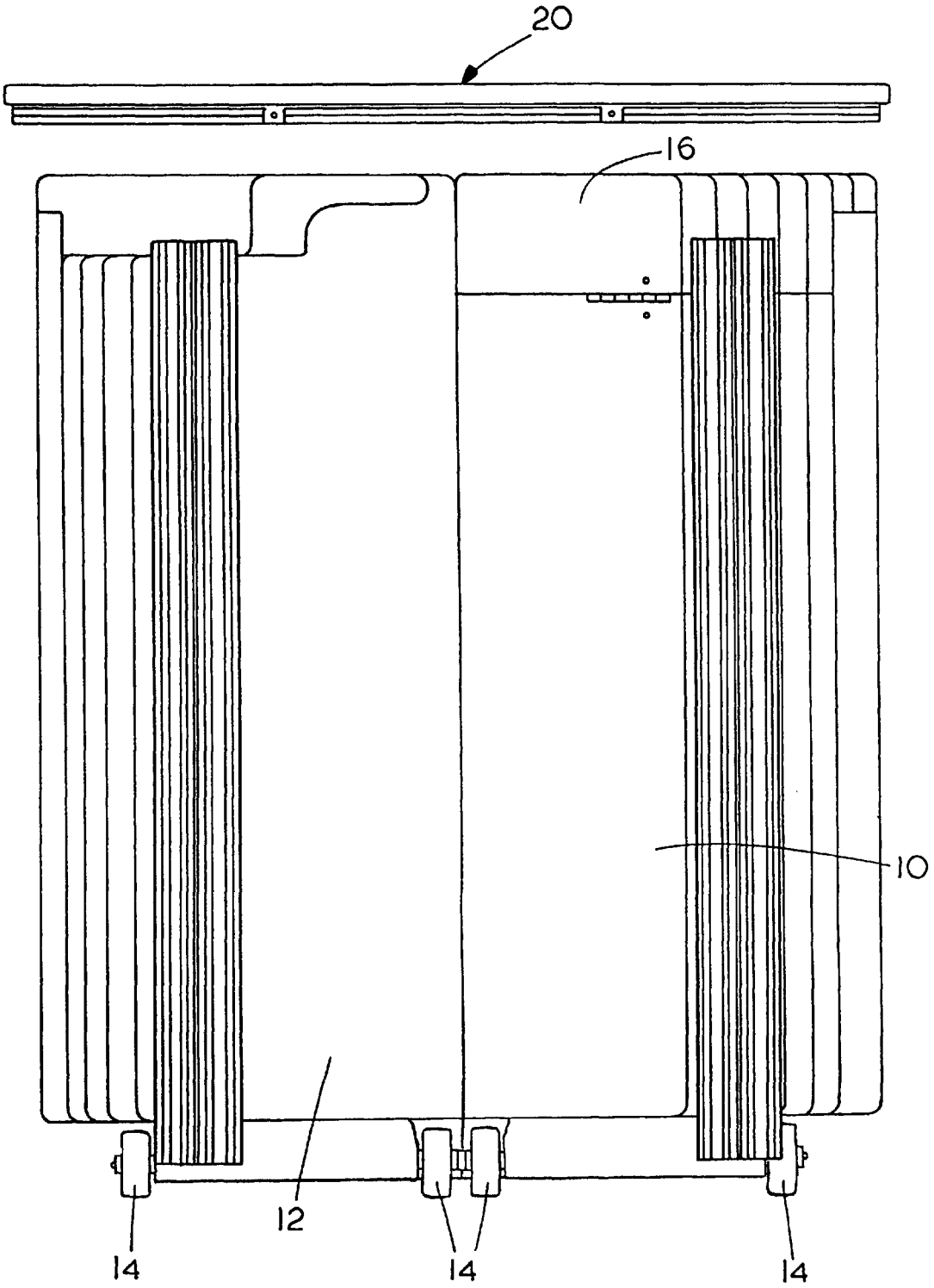
FIG. 1 is a side elevational view of a pair of folding trade show panel cases showing a countertop made according to the present invention in position to be installed thereon.

FIG. 1 illustrates a pair of cases shown at 10 and 12 that are positioned side by side, and which are formed to carry trade display panels (not shown) that comprise folding frames, and attachable "skins" that form dividers or supports for displays at a trade show. These cases 10 and 12 are generally molded from plastic, and are relatively rigid and are hollow. The cases 10 and 12 are generally supported on wheels 14, so they can be moved about. The cases have a top section 16 that is of generally of an oval shape when the cases are placed side by side, so that a countertop made according to the present invention and illustrated at 20 will fit over the upper case sections, and will be held in place.

Figure 2:
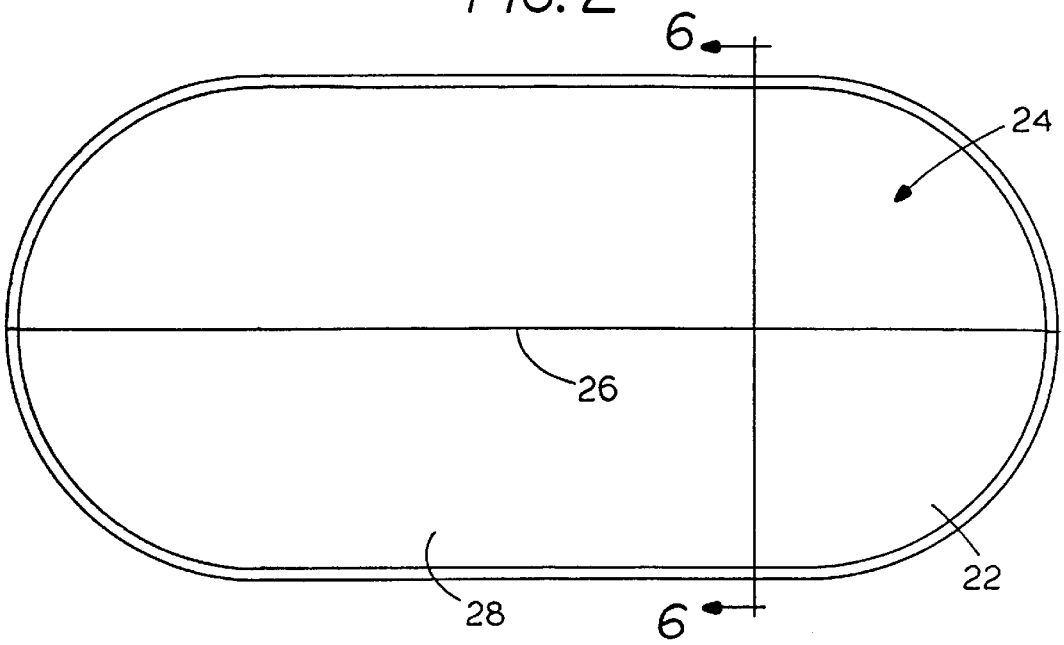
FIG. 2 is a top plan view thereof.
Figure 4:
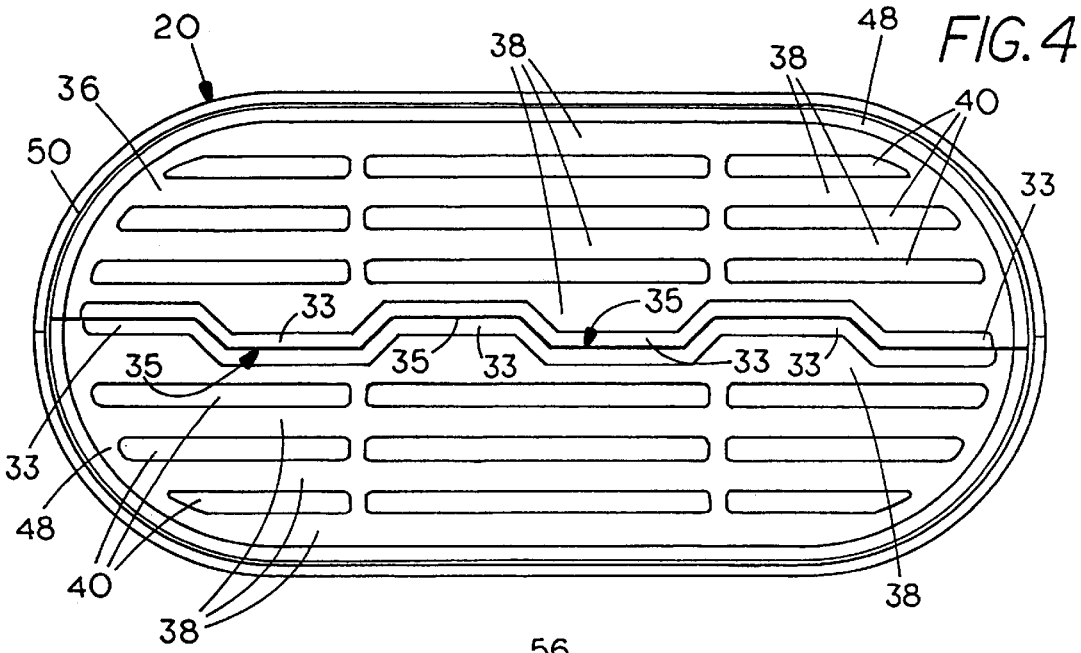
FIG. 4 is a bottom plan view of the top shown in FIG. 3.
Figure 5:
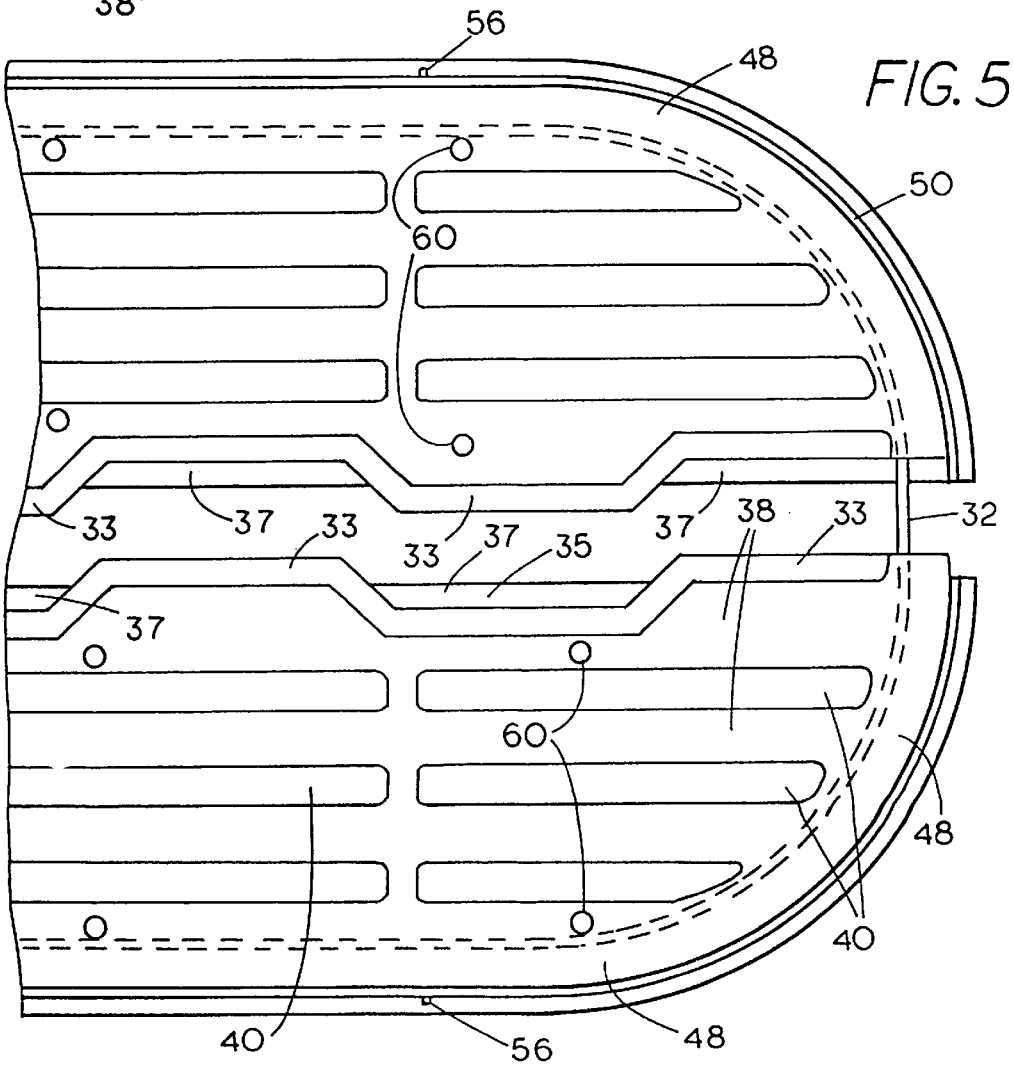
FIG. 5 is an enclosed fragmentary bottom view of one end of the countertop.
Figure 6:
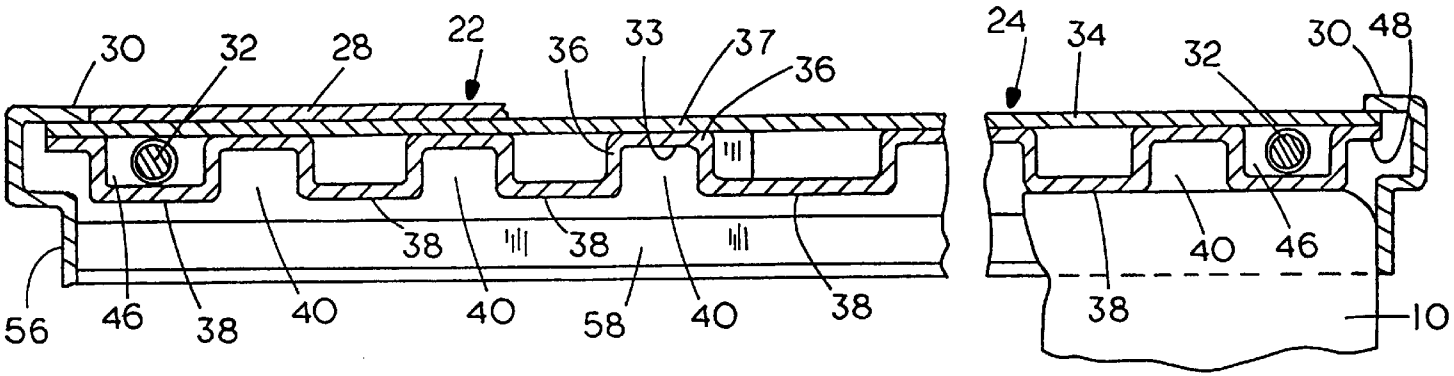
FIG. 6 is a sectional view taken on line 6—6 in FIG. 2.

The countertop 20 of a first form of the present invention is shown in more details in FIGS. 2–8, and specifically referring to FIG. 2, the countertop 20 is made up of two matching or mating top sections 22 and 24 that made along a junction line 26. The countertop sections 22 and 24 each have a desired surface layer 28 (such as Formica) , surrounded by a peripheral rim 30 that is slightly raised, as can be seen in FIG. 6 for example, and the two top sections 22 and 24 are made so that they are held together along the junction line 26 using an elastic cord 32 that is retained on the bottom side of the countertop 20.

Figure 3:
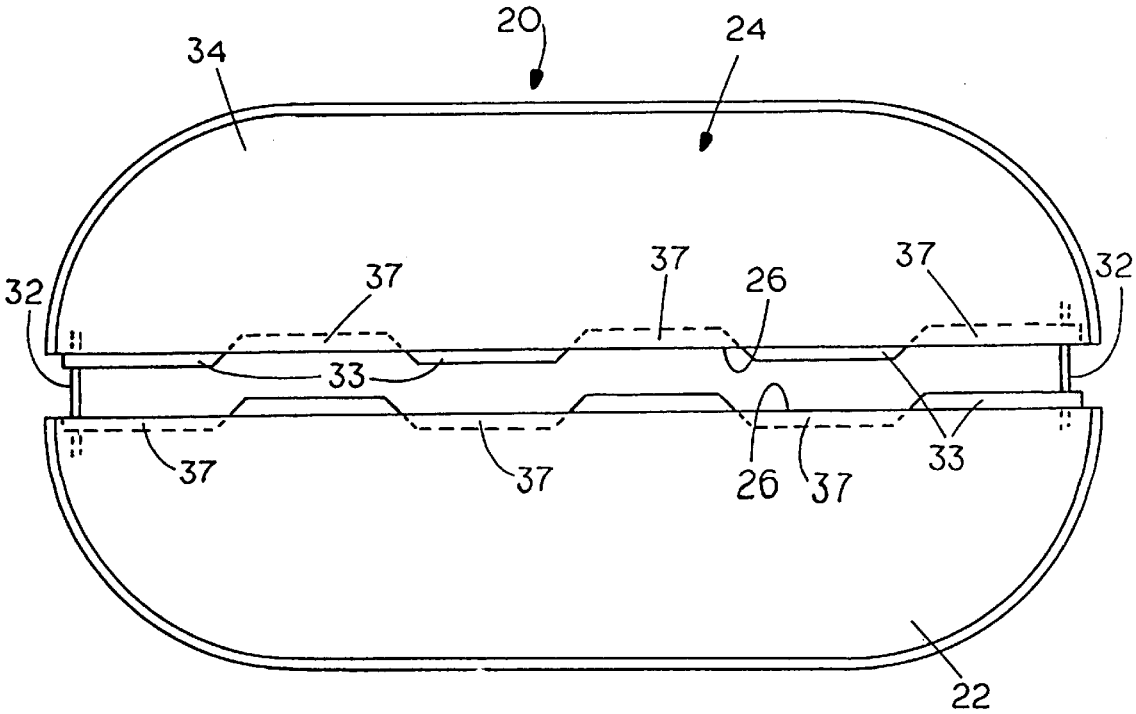
FIG. 3 is a plan view similar to FIG. 2 showing the two halves of the countertop separated.

For example, FIG. 3 shows the countertop sections 22 and 24 separated, and the elastic cord 32 is shown. The cord is of length so it urges the two sections 22 and 24 together along the junction line 26. As perhaps can be seen best in FIG. 6, which is an enlarged view, each of the top sections is made up of two independently molded layers that are joined together. This includes the flat top portion 34, and a support 36 that is molded separately and is made to have a series of ribs 38 and recesses 40 so that the support 36 supports the flat top portion 34 of each of the sections adequately.

As shown in FIG. 6, as well as in FIGS. 4 and 5, the tabs 33 are molded as part of the support 36 and while the supports are identical, they are complimentary so that sections 22 and 24 of the counter top will interfit with the flat tabs 33 on one-half portion of the countertop received in receptacles 35 formed on the bottom support of the other half portion. The tabs fit under and support the bottom side of edge portions 37 of the flat top 34 that are uncovered by the receptacles 35. This is shown in FIGS. 5 and 6, for example, as well as in FIG. 4.

FIG. 4 shows the tabs 33 and receptacles 35 nesting in the assembled condition and held together with the elastic cord 32. The elastic cord 32 is received in a peripheral raised portion of support that forms a channel 46 around both half sections (see FIG. 6). The channel 46 can vary in size, but it does pass around the entire periphery of the counter top 20. The cord 32, as shown in dotted lines in FIG. 5, is positioned around the periphery just inside the outermost flange 48 of the support section 36.

The elastic cord 32 is a continuous cord that is put into place when the support sections 36 are welded or otherwise secured to the flat top portions 34 on the bottom side of the top portions 34. The elastic cord 32 is of sufficient length and elasticity so that it will provide a resilient force to hold the two countertop sections 22 and 24 together under normal use, so that the sections will not separate.

Each of the countertop sections 22 and 24 have a depending flange 50 which extends beyond the plane of the supports 36, as shown in FIG. 6. Flange 50 then is made to receive a top portion of a case which is illustrated in broken lines in FIG. 6, to provide a stable support. The flange 50 has a small degree of clearance with respect to the case, or other pedestal or support that is used so that the centerline is not separated when the countertop sections are positioned on the cases.

Figure 6A:
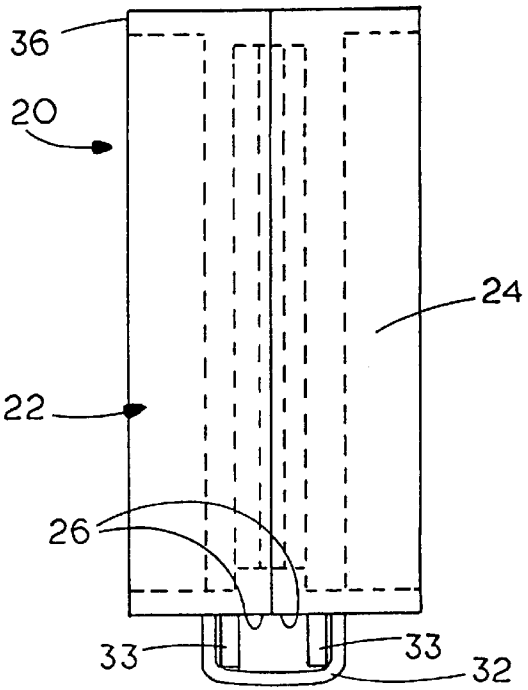
FIG. 6A is an edge view of the table top in a folded condition.

When the counter top 20 is to be stored, it can merely be separated as shown in FIG. 3, and then folded so that the two sections are contiguous to each other, as shown in FIG. 6A. The upper surfaces of sections 22 and 24 would fold together and face each other, and then the folded countertop assembly can be stored conveniently.

The elastic cord 32 will have sufficient elasticity for permitting separating the top sections while still exerting a retaining force to keep the junction line 26 closed in normal use.

The top sections can be molded to fit a desired pedestal by having the flange 50 shaped at the desired configuration.

Additionally, mounting rivets 56 (FIG. 5) can be provided at the flange 50 at desired locations for supporting panels or the like that can be used for encircling the cases 10 and 12 for decorative purposes or otherwise. Magnet strips can also be placed as shown at 58 in FIG. 6 to support a skirt or panel around the two cases. Other pedestals also can be used, as desired, with the folding countertop 20 of the present invention. Rubber bumpers 60 can be provided on the raised portions 38, as shown in FIG. 5.

Figure 7:
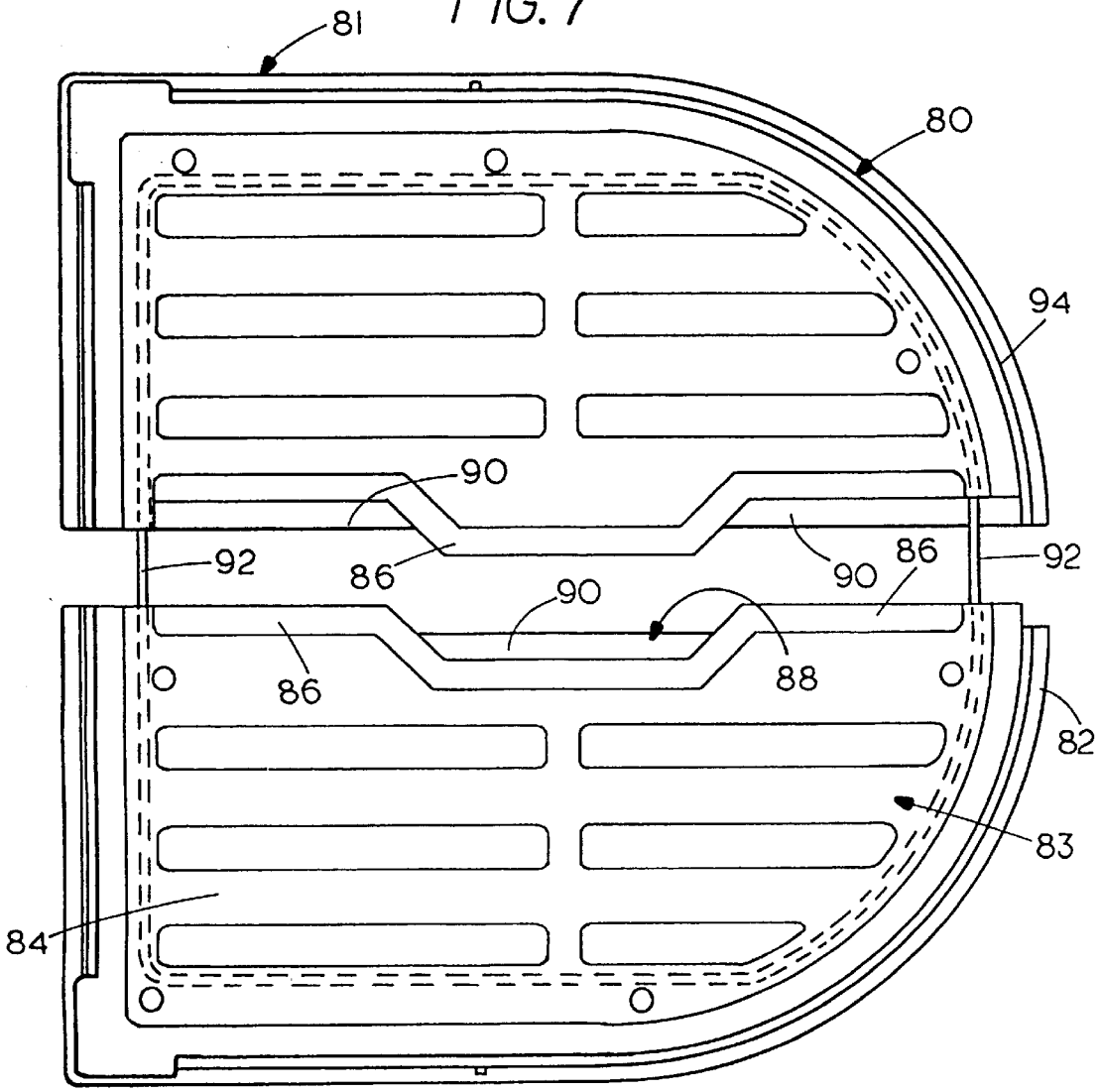
FIG. 7 is a bottom plan view of a modified form of the present invention used with a single case with the two halves separated.
Figure 8:
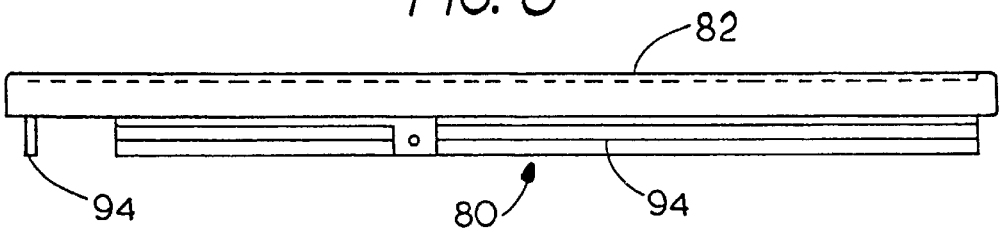
FIG. 8 is an edge view thereof.

In FIGS. 7 and 8, a modified form of the invention is shown. This is for mounting onto a single storage case, and it is essentially is one-half of the countertop shown in FIGS. 1–6A. In this instance, a countertop assembly 80 is formed in the same manner as before with half sections 81 and 83. Each half section includes a top 82 and a molded, ribbed support section 84, which are joined together. The sections 81 and 83 have to be made right and left hand, because there is a single center tab 86 in one of the sections, and to mate into a receptacle 88 in the other to support the top section 82 on the under surface of the top panel shown at 90 in FIG. 7. An elastic cord 92 is threaded through receptacles, as shown in dotted lines in FIG. 7, to hold the sections in assembly, and to permit separating the tab and folding the two sections 81 and 83 of the countertop assembly 80 together.

The support sections 84 can be molded with raised channels for additional strength, and the countertops 80 can be made so that the flanges 94 around the top sections 81 and 83 can be at corners if desired in order to fit the case on which they are to be mounted.

In this form of the invention, the two half sections also can be folded so that the upper surfaces of the top sections 86 are back to back while leaving the elastic cord 92 in place.

Thus, once assembled, the two support sections 84 of the top sections 81 and 83 will retain the elastic cord 92 in position. The cord can be placed in the provided receptacles at the time the top 82 is fastened to the support 84. This provides an attractive, sturdy and low cost countertop for use with trade show display cases.

Although the present invention has been described with reference to preferred embodiments, workers skilled in the art will recognize that changes may be made in form and detail without departing from the spirit and scope of the invention.

What is claimed is:

1. A folding countertop comprising a top members, the top member being made in two separable top sections having a junction line between the top sections, the too section each having a planar top portion and a support portion trommel to have a plurality of reinforcing channels, one of the channels on each top section being adjacent an exterior thereof to form a peripheral receptacle around an underside of the top member, said support portion being formed so that a side thereof engages and is secured to the under surface of the top member, a continuous elastic cord in the peripheral receptacle, and the elastic cord crossing the junction line in at least two spaced locations and being of sufficient elasticity to permit the top sections to separate along the junction line and so the top section fold to overlie one another.

2. The countertop of claim 1 and at least one tab along the junction line on at least one of the top sections that overlaps a portion of the other section and fits into a receptacle along the junction line of the other section.

3. The countertop of claim 1, wherein said elastic cord is a continuous cord that extends throughout the length of said peripheral groove.

4. The countertop of claim 1, wherein there are least two tabs on one section to underlie and support the top of the other section when the two top sections abut the junction line.

5. An assembly of a pedestal and a removable folding top assembly, the pedestal comprising at least one case used for storing and transporting trade show panels, top assembly including two top sections, said top sections having a generally planar upper surface and a flange around a peripheral edge that depends from the planar upper surface and surrounds the pedestal at an upper end of the pedestal, said top assembly being made in two sections and separated along a junction line, an elastic cord crossing the junction line in at least two locations, and being mounted to provide a resilient force urging the two top sections together such that thet top sections abut along the junction line.

6. The assembly of claim 5 including at least one tab member on one of the top sections that interfit with a receptacle on the other top section when the top sections are abutting along the junction line, and the tab member engaging an underside surface of a planar top wall having the planar upper surface thereon.

7. A pedestal and folding countertop combination comprising a pedestal having a peripheral configuration at an upper end thereof, a top member having a peripheral flange that depends from the top member and surrounds the upper portion of the pedestal with the top member mounted on the pedestal, the top member having a wall on an underside thereof, defining a peripheral receptacle within the peripheral wall of the top member, the top member being made in two separable top sections having a junction line between the sections, an elastic cord supported on an underside of the top member in the peripheral receptacle, the elastic cord crossing the junction line in at least two spaced locations and being of sufficient elasticity to permit the top section to separate along the junction line so the top sections fold to overlie one another and to hold the top sections together with the top member mounted on the pedestal.

* * * * *

UNITED STATES PATENT AND TRADEMARK OFFICE

CERTIFICATE OF CORRECTION

PATENT NO. : 5,967,060

DATED : October 19, 1999

INVENTOR(S) : Troy S. Savoie

It is certified that error appears in the above-identified patent and that said Letters Patent is hereby corrected as shown below:

Claim 1, column 4, line 6, delete "members", and replace with --member--.

Claim 5, column 4, line 34, before "top", insert --the--.

Claim 5, column 4, line 43, delete "thet", and replace with --the--.

Signed and Sealed this

Nineteenth Day of December, 2000

*Attest:*

*Attesting Officer*

Q. TODD DICKINSON

*Commissioner of Patents and Trademarks*